US010874282B2

(12) United States Patent
Kim et al.

(10) Patent No.: US 10,874,282 B2
(45) Date of Patent: Dec. 29, 2020

(54) PANEL ASSEMBLY, DISH WASHER, AND ELECTRONIC APPLIANCES

(71) Applicant: Samsung Electronics Co., Ltd., Suwon-si (KR)

(72) Inventors: Eun-seok Kim, Gunpo-si (KR); Jae-woo Lee, Seoul (KR); Jin-il Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 82 days.

(21) Appl. No.: 15/367,940

(22) Filed: Dec. 2, 2016

(65) Prior Publication Data

US 2017/0159351 A1 Jun. 8, 2017

(30) Foreign Application Priority Data

Dec. 3, 2015 (KR) ..... 10-2015-0171351

(51) Int. Cl.
*A47L 15/42* (2006.01)

(52) U.S. Cl.
CPC ..... *A47L 15/4265* (2013.01)

(58) Field of Classification Search
CPC ..... A47L 15/4265
See application file for complete search history.

(56) References Cited

U.S. PATENT DOCUMENTS 4,765,697 A * 8/1988 Gardell ..... A47L 15/4257 312/213
2005/0285487 A1 12/2005 Noh
2008/0011342 A1 1/2008 Ryu et al.
2008/0035183 A1 2/2008 Kuecuek et al.
2008/0290770 A1 11/2008 Rockwell et al.
2013/0113353 A1* 5/2013 Carr ..... A47L 15/4265 312/293.3
2013/0300268 A1* 11/2013 Schaefer ..... A47L 15/4265 312/228

FOREIGN PATENT DOCUMENTS

| | | | |
|---|---|---|---|
| CN | 203828881 | 9/2014 | |
| EP | 2465403 A2 * | 6/2012 | ..... A47L 15/4257 |
| JP | 6-42606 | 11/1994 | |
| KR | 10-2005-0122349 | 12/2005 | |
| KR | 10-2007-0039545 | 4/2007 | |
| KR | 10-2008-0006408 | 1/2008 | |

OTHER PUBLICATIONS

Machine Translation of EP2465403A2 (Year: 2012).*
Korean Office Action dated Jul. 22, 2019 in Korean Patent Application No. 10-2015-0171351.

* cited by examiner

*Primary Examiner* — Spencer E Bell
(74) *Attorney, Agent, or Firm* — Staas & Halsey, LLP

(57) ABSTRACT

A panel assembly including a corner member is provided. The panel assembly according to an exemplary embodiment of the present disclosure includes: a frame panel consisting of one sheet of metal plate and having a front surface, an upper surface bent from the front surface, and a side surface bent from the front surface; and a corner member coupled with a gap formed between the upper surface of the frame panel and the side surface of the frame panel, in which the corner member includes an exposed portion exposed to the outside and a buried portion covered with the upper surface or the side surface of the frame panel.

19 Claims, 22 Drawing Sheets

PANEL ASSEMBLY, DISH WASHER, AND ELECTRONIC APPLIANCES

CROSS-REFERENCE TO RELATED APPLICATIONS

This application claims priority from Korean Patent Application No. 10-2015-0171351, filed on Dec. 3, 2015 in the Korean Intellectual Property Office, the disclosure of which is incorporated herein by reference in its entirety.

BACKGROUND OF THE INVENTION

Field of the Invention

Apparatuses and methods consistent with the present disclosure relate to a panel assembly, a dish washer, and electronic appliances, and more particularly, to a panel assembly including a corner member forming edges of a frame panel, a dish washer, and electronic appliances.

Description of the Related Art

Recently, besides functions of various electronic appliances, a design of the electronic appliances is getting more important. Therefore, various designs for increasing aesthetics of appearance of electronic appliances have been developed and applied.

The electronic appliances such as a dish washer, a refrigerator, and a microwave oven may be configured to include a main body formed with an opening and a door opening and closing the opening, in which the main body and the door may be configured by a coupling of panel assemblies. Among those, in the case of electronic appliances such as the dish washer, the refrigerator, and the microwave oven that may be received in the main body, the door opening and closing the opening of the main body may be configured of a plurality of frame panels.

Generally, the frame panel is manufactured by bending a sheet like a metal plate that is a raw material to mold the sheet into an approximate three-dimensional structure and then joining joints of the respective surfaces, which are formed by bending the metal plate, by welding, etc., to form an appearance. In the frame panel, a contact portion at which three different surfaces meet may be formed with a sharp edge and a surface of the joint may be deformed to be rough during the welding process.

Therefore, the aesthetics of the electronic appliances may be reduced due to the sharp edge of the frame panel or the joint of which the surface is deformed to be rough or a user may be injured by being bumped into the edges of the frame panel.

Therefore, a process of making the edge portions of the frame panel round is additionally applied in a manufacturing process of the frame panel. Conventionally, to manufacture the frame panel having the edge parts to which a curved design is applied, the metal plate is bent to meet the shape of the frame panel, the joints of the respective surfaces forming the appearance of the frame panel are joined by the welding, and then the sharp edge or the rough surface portion of the frame panel is grinding to deform the edge to the shape of the curved portion.

However, the related art has a disadvantage in that a coated portion coated on the metal plate is peeled off during the welding or grinding process and thus a color may be changed or a unique color of metal forming the metal plate may be changed. Further, in the manufacturing process of the frame panel, a separate welding process of joining the respective surface forming the appearance of the frame panel is additionally required.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present disclosure provides a panel assembly including a corner member forming edges of a frame panel, a dish washer, and electronic appliances.

According to an aspect of the present disclosure, a panel assembly includes: a frame panel consisting of one sheet of metal plate and having a front surface, an upper surface bent from the front surface, and a side surface bent from the front surface; and a corner member coupled with a gap formed between the upper surface of the frame panel and the side surface of the frame panel, in which the corner member includes an exposed portion exposed to the outside and a buried portion covered with the upper surface or the side surface of the frame panel.

The corner member may be made of a synthetic resin material.

A surface connected to the side surface of the frame panel from the upper surface of the frame panel through the exposed portion of the corner member may be formed without a step.

A surface of the exposed portion may include a curved surface.

The buried portion may include a first buried portion extending in parallel with the upper surface of the frame panel from the exposed portion and a second buried portion extending in parallel with the side surface of the frame panel from the exposed portion.

The exposed portion and the buried portion may be integrally formed.

The panel assembly may further include: a control panel disposed at a rear of the frame panel, in which the corner member may include a coupling portion coupled with the control panel.

The buried portion may include an edge buried portion extending along an edge at which the front surface and the side surface of the frame panel meet each other.

According to another aspect of the present disclosure, electronic appliances include: a main body formed with an opening; a door opening and closing the opening; a frame panel forming at least a part of a front surface of the door; and a corner member coupled with a gap formed between an upper surface and a side surface of the frame panel, in which the corner member may include an exposed portion exposed to the outside and a buried portion covered with the upper surface or the side surface of the frame panel.

The electronic appliances may further include: a control panel disposed at a rear of the frame panel, in which the corner member may be formed at one side of the control panel.

The electronic appliances may further include: a display part formed on the frame panel.

The frame panel may be made of a metal material and the corner member may be made of a synthetic resin material.

The exposed portion and the buried portion may be integrally formed.

According to another aspect of the present disclosure, a dish washer includes: a main body having an opening through which a dinner set is loaded into a washing space formed therein; a door opening and closing the opening; a frame panel made of a metal material and forming a part of the door; and a corner member coupled with a gap formed between an upper surface and a side surface of the frame panel, in which the corner member may include an exposed portion exposed to the outside and a buried portion covered with the upper surface or the side surface of the frame panel.

The corner member may be made of a synthetic resin material and the exposed portion and the buried portion may be integrally formed.

A surface connected to the side surface of the frame panel from the upper surface of the frame panel through the exposed portion of the corner member may be formed without a step.

The buried portion may include a first buried portion extending in parallel with the upper surface of the frame panel from the exposed portion and a second buried portion extending in parallel with the side surface of the frame panel from the exposed portion.

The dish washer may further include: a control panel disposed at a rear of the frame panel, in which the corner member may include a coupling portion coupled with the control panel.

The dish washer may further include: a display part formed on the frame panel.

The buried portion may include an edge buried portion extending along an edge at which the front surface and the side surface of the frame panel meet each other.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
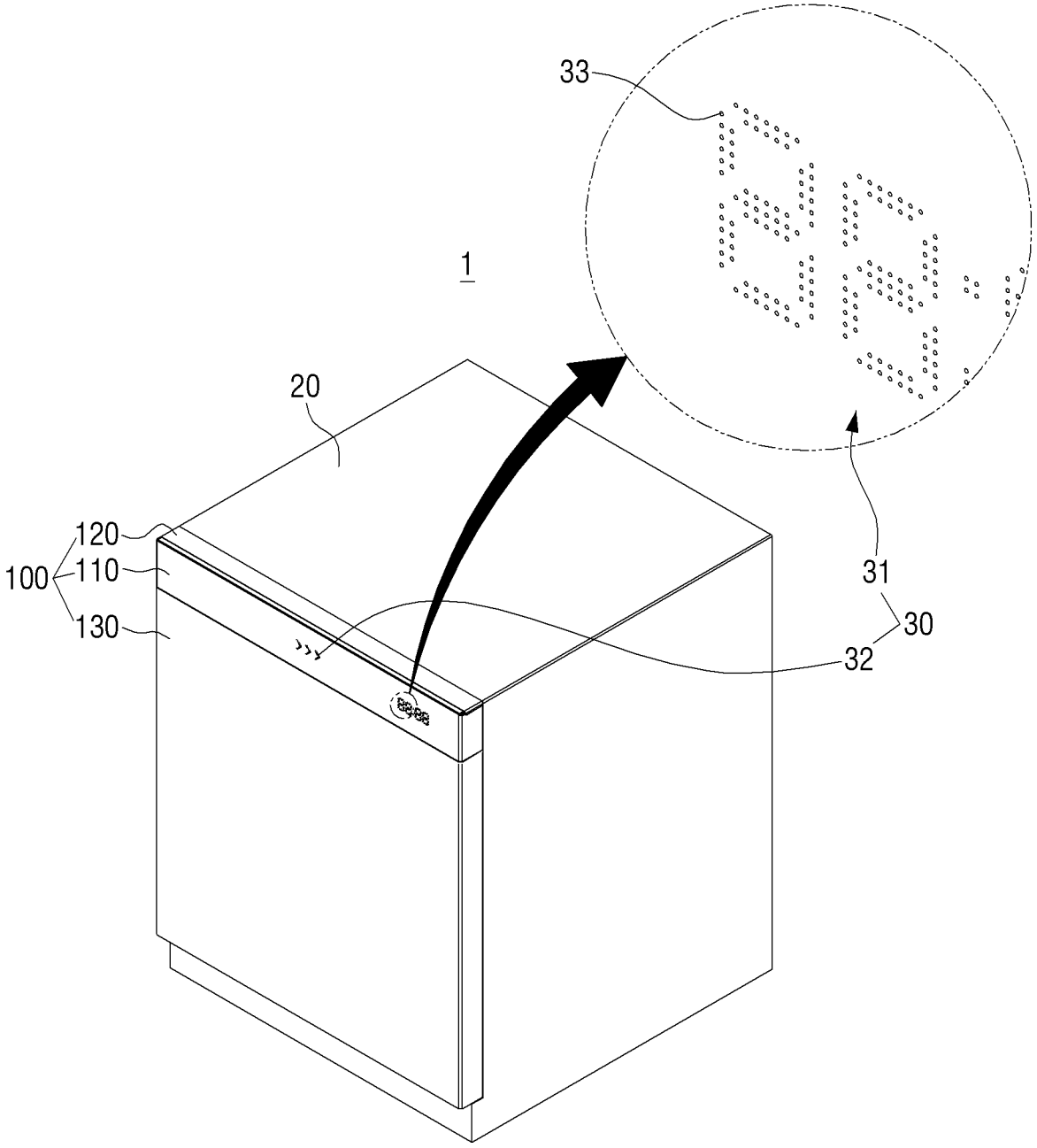
FIG. 1 is a diagram illustrating a dish washer as an example of electronic appliances according to an exemplary embodiment of the present disclosure.

Hereinafter, exemplary embodiments of the present disclosure will be described in detail with reference to the accompanying drawings. The following exemplary embodiments will be described based on exemplary embodiments most appropriate to understand technical features of the present disclosure and the technical features of the present disclosure are not limited to the exemplary embodiments to be described below but it is illustrated that the present disclosure may be implemented like exemplary embodiments to be described.

Therefore, the present disclosure may be variously changed within the technical scope of the present disclosure in accordance with the exemplary embodiments to be described below and the changed exemplary embodiments may be considered to be included in the technical scope of the present disclosure. Further, to help understand the following exemplary embodiments, in signs described in the accompanying drawing, relevant components among components performing the same operations in each exemplary embodiment are denoted by reference numerals on the same or extending line.

Figure 2:
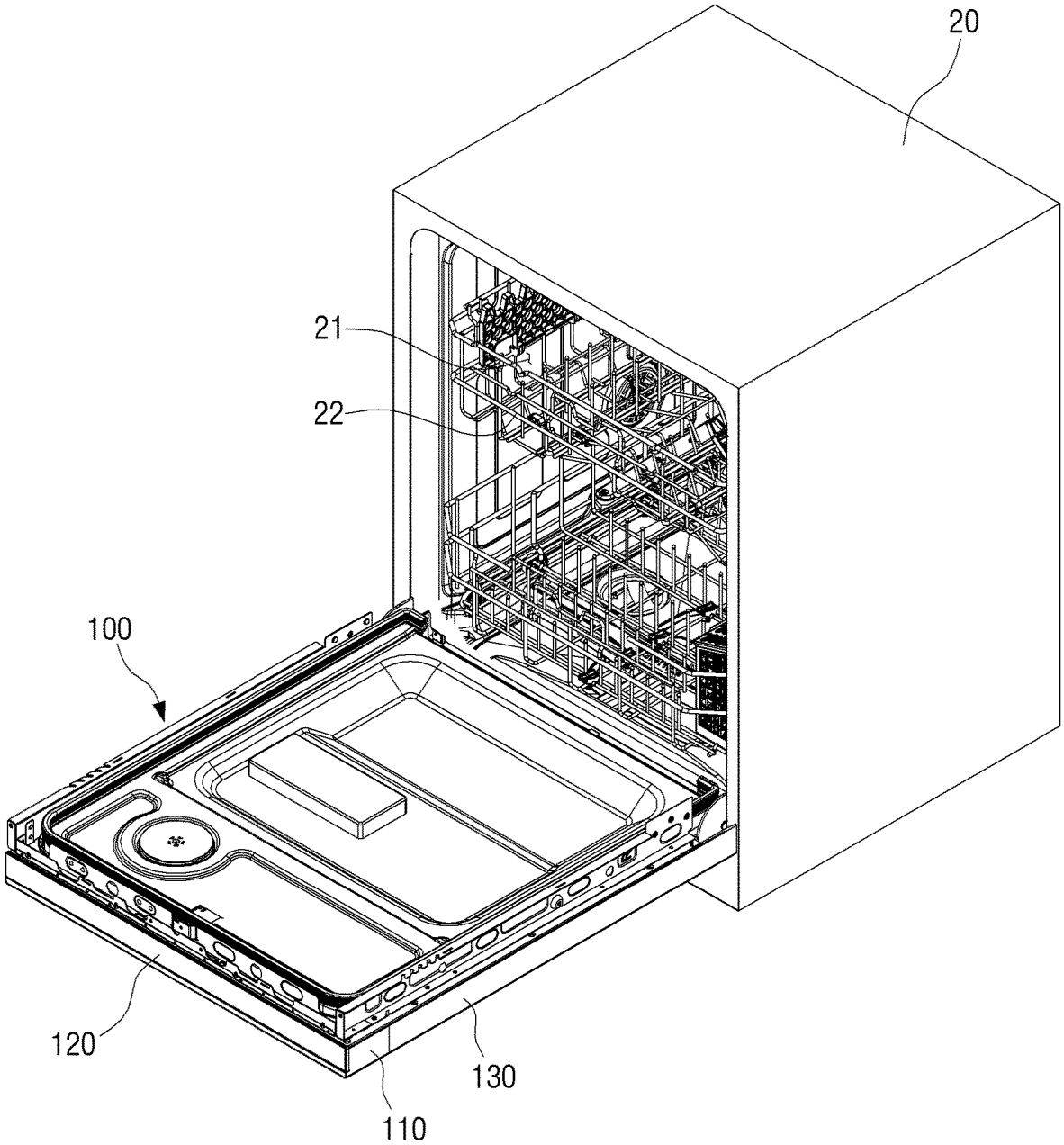
FIG. 2 is a diagram illustrating a state in which a door of the dish washer illustrated in FIG. 1 is open.

FIG. 1 is a diagram illustrating a dish washer 1 as an example of electronic appliances according to an exemplary embodiment of the present disclosure and FIG. 2 is a diagram illustrating a state in which a door 100 of the dish washer 1 illustrated in FIG. 1 is open. For convenience of explanation, as the electronic appliances according to the exemplary embodiment of the present disclosure, the dish washer 1 will be described as an example. However, the electronic appliances according to the exemplary embodiment of the present disclosure may be various electronic appliances such as a refrigerator, a microwave oven, etc., that include a main body and a door.

The overall appearance of the dish washer 1 may have a rectangular parallelepiped box shape and may include a main body 20 formed with an opening 21 and a door 100 disposed on a front surface of the main body 20.

An inside of the main body 20 may be provided with a washing tank 22 and a user may load a dinner set into the washing tank 22 through an opened door 100.

The door 100 may include a plurality of frame panels 110 and 130 and a control panel 120. Further, the plurality of frame panels 110 and 130 and the control panel 120 are coupled with each other to form various panel assemblies configuring the dish washer 1 as well as the door 100.

The frame panel 110 may form a part of the front surface of the door 100 and the coupling of the plurality of frame panels 110 and 130 may form the whole of the front surface of the door. Further, only one frame panel may also form the whole of the front surface of the door. Further, the frame panel 110 may be a component of various parts and panel assemblies configuring the dish washer 1 besides the door 100.

The frame panel 110 may further include a display part 30 that may display operation information of the dish washer 1. The number of display parts 30 is plural and the display part 30 may include first and second display parts 31 and 32. The display part 30 may include a plurality of through holes 33 perforated in the frame panel 110 to form shapes each corresponding to letters, pictures, etc., that can display the operation information of the dish washer 1. Therefore, when a display unit (not shown) disposed at a position corresponding to the display part 30 on a rear surface of the frame panel 110 displays specific characters, pictures, etc., that may display the operation information of the dish washer 1, the specific characters, pictures, and the like can be displayed on the front of the door 100 through the display part 30. In addition, the display unit may also be coupled with the fame panel to be directly exposed to the outside on the front surface of the frame panel 110. The display part 30 and the display unit are the same as or similar to those used in the related art, and thus detailed description thereof will be omitted.

The main body 20 and the door 100 may be made of a metal material, and may be made of a synthetic resin material or other compositions. Accordingly, the frame panel 110 can also be made of a metal material, and can be made of a synthetic resin material and other compositions. Hereinafter, for convenience of description, it is described as an example that the frame panel 110 is made of a metal material. In addition, the frame panel 110 may have a color inherent to the raw material, and the outer surface thereof may be colored by a separate coating. For example, the frame panel 110 is made of metal materials such as aluminum or iron, and can have an inherent color of metal, and the outer surface thereof may be coated with colors such as white and black.

Figure 3:
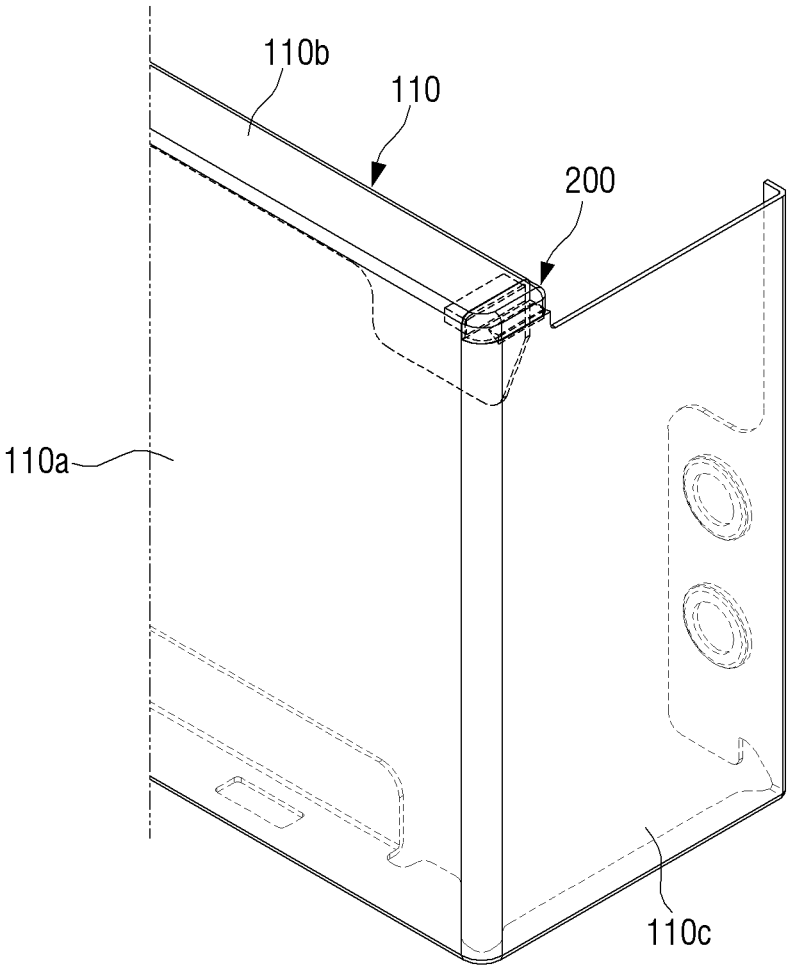
FIG. 3 is a diagram illustrating an appearance in which a frame panel and a corner member according to a first exemplary embodiment of the present disclosure are coupled with each other.
Figure 4:
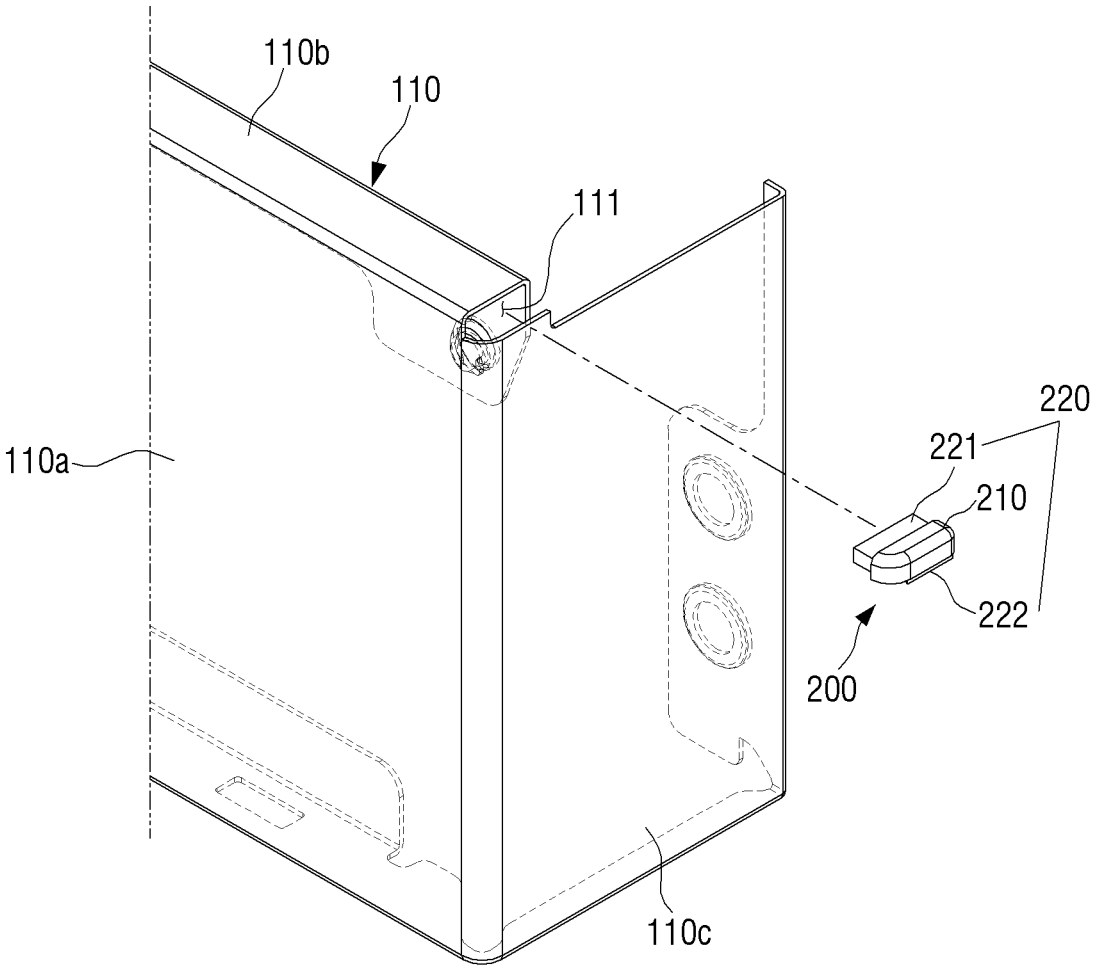
FIG. 4 is a diagram illustrating an appearance in which the frame panel and the corner member illustrated in FIG. 3 are separated from each other.

FIG. 3 is a diagram illustrating an appearance in which the frame panel 110 and the corner member 200 according to a first exemplary embodiment of the present disclosure are coupled with each other and FIG. 4 is a diagram illustrating an appearance in which the frame panel 110 and the corner member 200 illustrated in FIG. 3 are separated from each other.

The frame panel 110 according to the first exemplary embodiment of the present disclosure may be molded by bending one sheet of metal plate and thus may include a front surface 110*a* and upper surface 110*b* and a side surface 110*c* bent from the front face 110*a*.

The frame panel 110 may have a gap 111 formed between the upper surface 110*b* and the side surface 110*c* without connecting the front surface 110*a*, the upper surface 110*b* and the side surface 110*c* molded through the one sheet of metal plate to each other by welding.

Therefore, the edge part of the frame panel 110 may include an empty gap 111, not a sharp tip, and the gap 111 may be coupled with a corner member 200 that may replace the edge of the empty frame panel 110. The color of the corner member 200 may be the same as the color of the frame panel 110.

Figure 5:
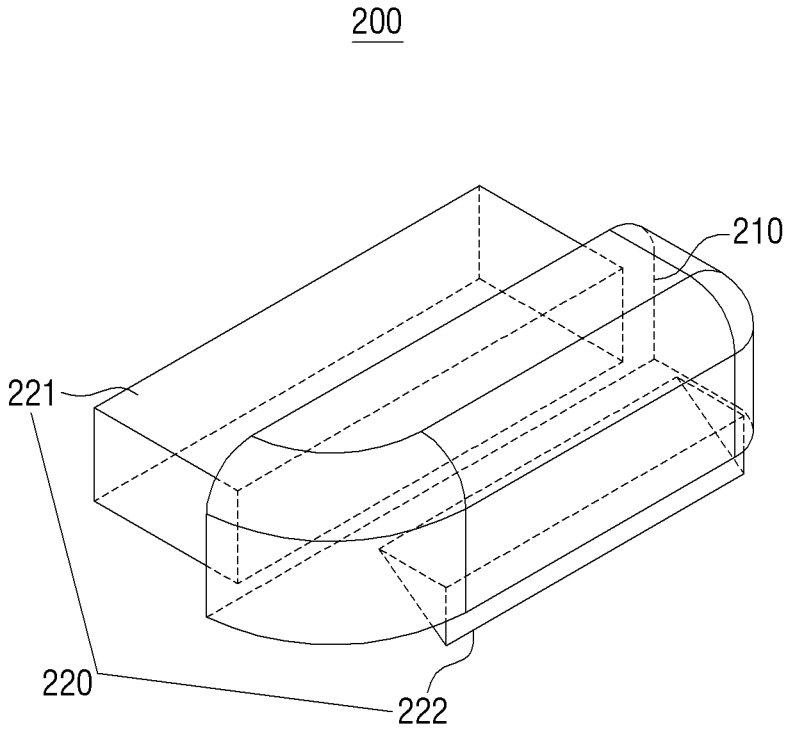
FIG. 5 is an enlarged view of the corner member illustrated in FIG. 3.

FIG. 5 is an enlarged view of the corner member 200 according to a first exemplary embodiment of the present disclosure. Hereinafter, the configuration of the corner member 200 and a scheme of coupling the corner member 200 with the gap 111 will be described in detail with reference to FIGS. 3 to 5.

The corner member 200 may include an exposed portion 210 and a buried portion 220. When the corner member 200 is coupled to the gap 111, the exposed portion 210 is exposed to the outside of the frame panel 110 to form the edge of the frame panel 110, and the buried portion 220 is buried into the inside of the frame panel 110 to fix the corner member 200 so that the corner member 200 is stably coupled to the frame panel 110.

The surface of the exposed portion 210 that forms the edge of the frame panel 110 may include a curved surface. In addition, the surface of the exposed portion 210 that forms the edge of the frame panel 110 may also be deformed into various shapes. Therefore, the shape of the surface of the exposed portion 210 may be changed from a shape of the sharp edge of the existing frame panel to a shape including a curved surface.

Further, the surface of the exposed portion 210 may be connected to the outer surface of the frame panel 110 without being separated and stepped from the outer surface of the frame panel 110. Therefore, in the frame panel 110 with which the corner member 200 is coupled, the surface of the exposed portion 210 connected to the side surface of the frame panel 110 from the upper surface 110*b* of the frame panel 110 through the exposed portion 210 of the corner member 200 may be continuously connected without separation and step. In this way, the edge of the frame panel 110 can be replaced with a shape including a continuous curved surface from the outer surface of the frame panel 110 by the exposed portion 210. Further, the number of gaps 111 of the frame panel 110 and the number of corner members 200 coupled to the gaps 111 may be plural according to the shape of the frame panel 110.

The buried portion 220 may have a shape in which one side thereof extends from the exposed portion 210 and may be covered with the front surface 110*a*, the upper surface 110*b*, or the side surface 110*c* of the frame panel 110. Therefore, the buried portion 210 can be inserted into the frame panel 110 to fix the corner member 200 coupled with the frame panel 110. Further, the buried portion 220 may be integrally formed with the exposed portion 210.

The buried portion 220 may have a shape corresponding to an inner space of the gap 111 so that the buried portion 220 can be press-fitted in a manner that it is inserted into an inner side of the frame panel 110. Therefore, the corner member 200 may be firmly fixed to the gap 111. In addition, the buried portion 220 can be attached to the inner side of the frame panel 110 by an adhesive, a double-sided tape, or the like.

The buried portion 220 may include first and second buried portions 221 and 222. The first buried portion 221 may extend in parallel with the upper surface 110*b* of the frame panel 110 by extending a part of the side surface of the exposed portion 210. The second buried portion 222 may extend in parallel with the side surface 110*c* of the frame panel 110 by extending a part of a bottom surface of the exposed portion 210. Therefore, the first buried portion 221 is covered by the upper surface 110*b* of the frame panel 110 and the second buried portion 222 is covered by the side surface 110*c* of the frame panel 110, such that the corner member 200 can be more firmly fixed to the frame panel 110.

As described above, the corner member 200 according to the first embodiment of the present disclosure is coupled with the gap 111 of the frame panel 110, so that the shape of the edge of the frame panel 110 can be replaced with various shapes as well as a curved shape without any additional welding or grinding process. In addition, the panel assembly may be assembled by connecting the front surface 110*a*, the upper surface 110*b*, and the side surface 110*c* of the frame panel 110 to each other through the exposed portion 210 without a separate welding process, and thus the entire manufacturing process of the dish washer 1 including the frame panel 110 may be simplified.

The frame panel 110 and the corner member 200 may be made of different materials. The corner member 200 may be made of a synthetic resin material and may be molded by injection molding. Therefore, the corner member 200 may be easily manufactured in various colors and shapes. In this way, even though the frame panel 110 is made of a metal material, the corner member 200 having a desired shape and color may be manufactured without any separate welding or grinding process and coupled with the frame panel 110. Therefore, the edges of the frame panel 110 can be easily replaced to be the desired shape while preventing the coating of the frame panel 110 from being peeled off or colors from being changed due to welding or grinding.

Further, as illustrated in FIGS. 4 and 5, the second buried portion 222 may include an inclined surface in a direction in which it is coupled to the frame panel 110. Therefore, when the corner member 200 is inserted from the side of the frame panel 110, the inclined surface of the second buried portion 222 may slid in a state in which it interferes with one end of the side surface 110*c* of the frame panel 110 to be snap-fitted into the side 110*c* of the frame panel 110. In this way, the corner member 200 may be more firmly coupled with the frame panel 110.

Although the first exemplary embodiment of the present disclosure describes, by way of example, the configuration in which the inclined surface is provided in the second buried portion 222 so that the second buried portion 222 is snap-fitted to the frame panel 110, the disposition of the inclined surface may be variously changed, and thus the snap-fitting scheme may also be changed.

FIGS. 6 to 22 illustrate the second to seventh exemplary embodiments of the present disclosure. In describing each exemplary embodiment of the present disclosure, the overlapping description of the same or similar configuration as that of the first exemplary embodiment will be omitted but features of each exemplary embodiment will be mainly described below.

Figure 6:
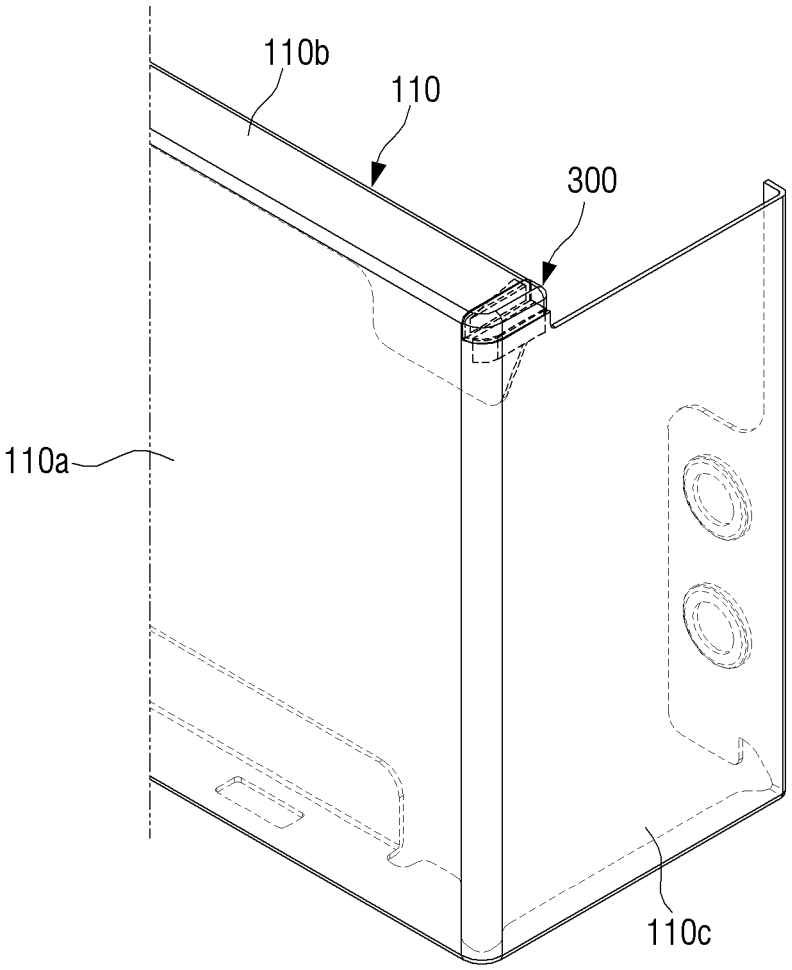
FIG. 6 is a diagram illustrating an appearance in which the frame panel and a corner member according to a second exemplary embodiment of the present disclosure are coupled with each other.
Figure 7:
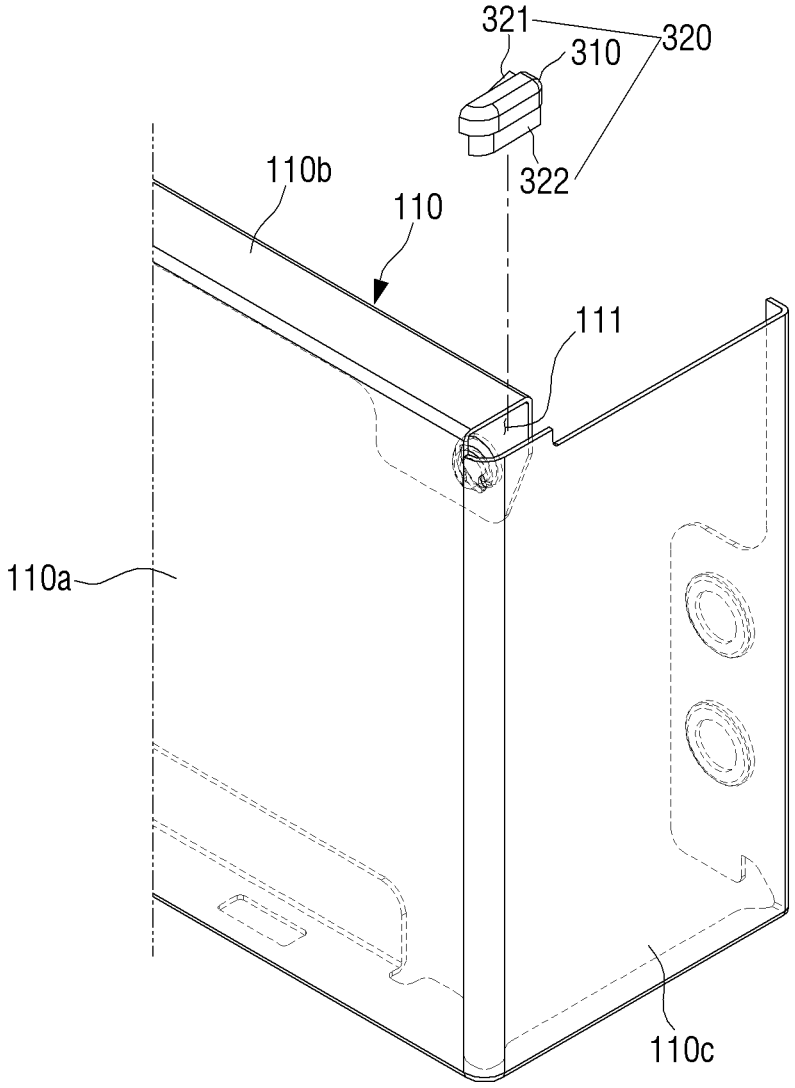
FIG. 7 is a diagram illustrating an appearance in which the frame panel and the corner member illustrated in FIG. 6 are separated from each other.
Figure 8:
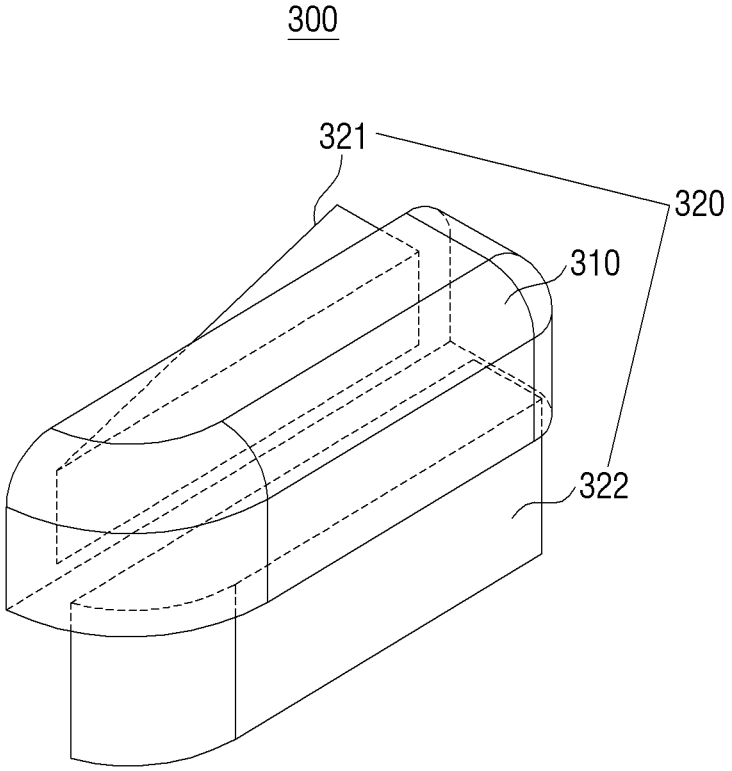
FIG. 8 is an enlarged view of the corner member illustrated in FIG. 6.

FIG. 6 is a diagram illustrating the appearance in which the frame panel 110 and a corner member 300 according to a second exemplary embodiment of the present disclosure are coupled with each other, FIG. 7 is a diagram illustrating the appearance in which the frame panel 110 and the corner member 300 illustrated in FIG. 6 are separated from each other, and FIG. 8 is an enlarged view of the corner member 300.

The corner member 300 and the frame panel 110 according to the second exemplary embodiment of the present disclosure will be described with reference to FIGS. 6 to 8. The corner member 300 may be coupled with the gap 111 of the frame panel 110 and may include an exposed portion 310 and a buried portion 320. Since the configuration of the exposed portion 310 forming the corner of the frame panel 110 is the same as that of the exposed portion 210 of the first exemplary embodiment, a detailed description thereof will be omitted, and the difference between the buried portion 320 according to the second exemplary embodiment of the present disclosure and the buried portion 220 according to the first exemplary embodiment will be mainly described The buried portion 320 may include first and second buried portions 321 and 322. The first buried portion 321 may extend in parallel with the upper surface 110*b* of the frame panel 110 by extending a part of the side surface of the exposed portion 310. The second buried portion 322 may extend in parallel with the side surface 110*c* of the frame panel 110 by extending a part of a bottom surface of the exposed portion 310. Therefore, the first buried portion 321 is covered by the upper surface 110*b* of the frame panel 110 and the second buried portion 322 is covered by the side surface 110*c* of the frame panel 110, such that the corner member 300 can be more firmly fixed to the frame panel 110.

The corner member 300 including the buried portion 320 may be inserted along the side surface 110*c* from the rear of the frame panel 110. As illustrated in FIG. 8, the first buried portion 321 may include an inclined surface formed toward the front surface 110*a* of the frame panel 110, and thus the first buried portion 321 may be snap-fitted into the upper surface 110*b* of the frame panel 110.

Figure 9:
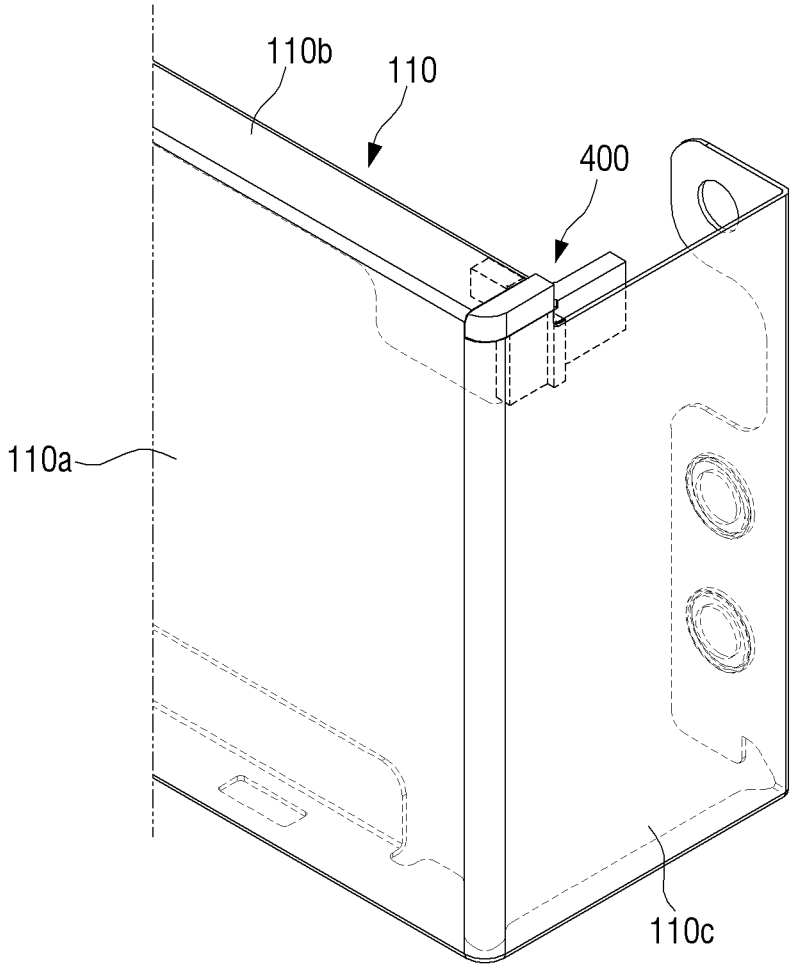
FIG. 9 is a diagram illustrating an appearance in which the frame panel and a corner member according to a third exemplary embodiment of the present disclosure are coupled with each other.
Figure 10:
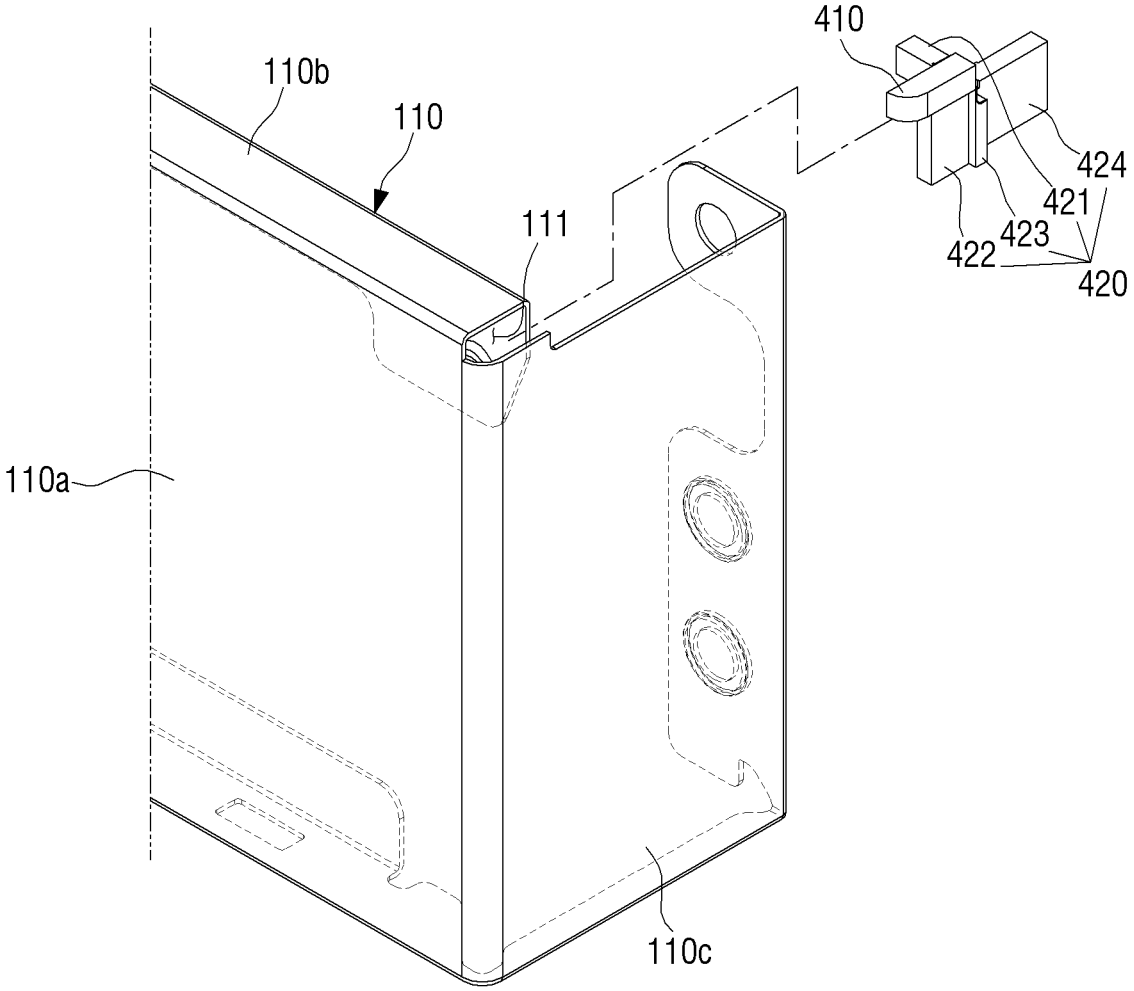
FIG. 10 is a diagram illustrating an appearance in which the frame panel and the corner member illustrated in FIG. 9 are separated from each other.
Figure 11:
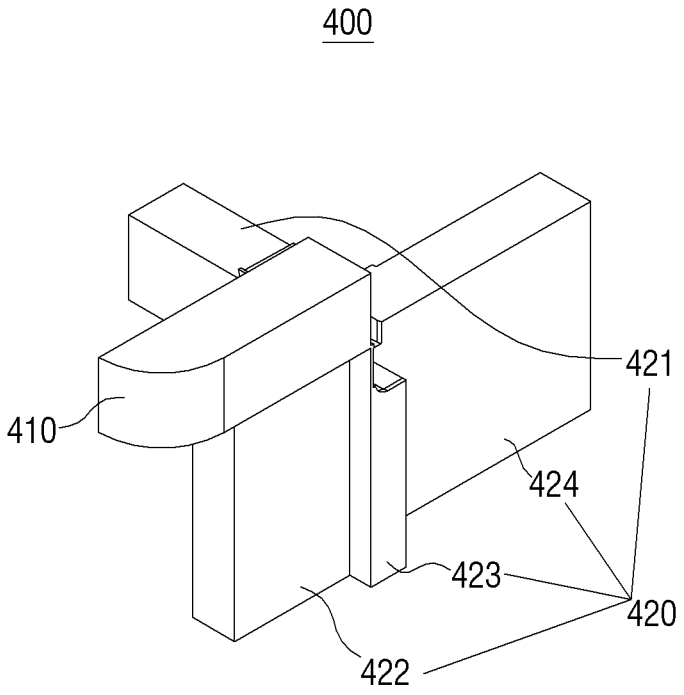
FIG. 11 is an enlarged view of the corner member illustrated in FIG. 9.

FIG. 9 is a diagram illustrating the appearance in which the frame panel 110 and a corner member 400 according to a third exemplary embodiment of the present disclosure are coupled with each other, FIG. 10 is a diagram illustrating the appearance in which the frame panel 110 and the corner member 400 illustrated in FIG. 9 are separated from each other, and FIG. 11 is an enlarged view of the corner member 400.

The corner member 400 and the frame panel 110 according to the third exemplary embodiment of the present disclosure will be described with reference to FIGS. 9 to 11. The corner member 400 may include an exposed portion 410 and a buried portion 420. The configuration of the exposed portion 410 is similar to that of the exposed portion 210 according to the first exemplary embodiment of the present disclosure and therefore the overlapping description thereof will be omitted.

The buried portion 420 may include first to fourth buried portions 421 to 424. The buried portion 420 may be inserted into the frame panel 110 through the gap 111.

The first buried portion 421 may extend in parallel with the upper surface 110*b* of the frame panel 110 by extending a part of the side surface of the exposed portion 410. The second buried portion 422 may extend in parallel with the side surface 110*c* of the frame panel 110 by extending a part of a bottom surface of the exposed portion 410. The third and fourth buried portions 423 and 424 may be formed by extending a part of the second buried portion 422 and may be coupled with other parts (not shown) that may be coupled with the rear of the frame panel 110. In this way, the corner member 400 including the first to fourth buried portions 421 to 424 can be more firmly fixed to the frame panel 110.

Figure 12:
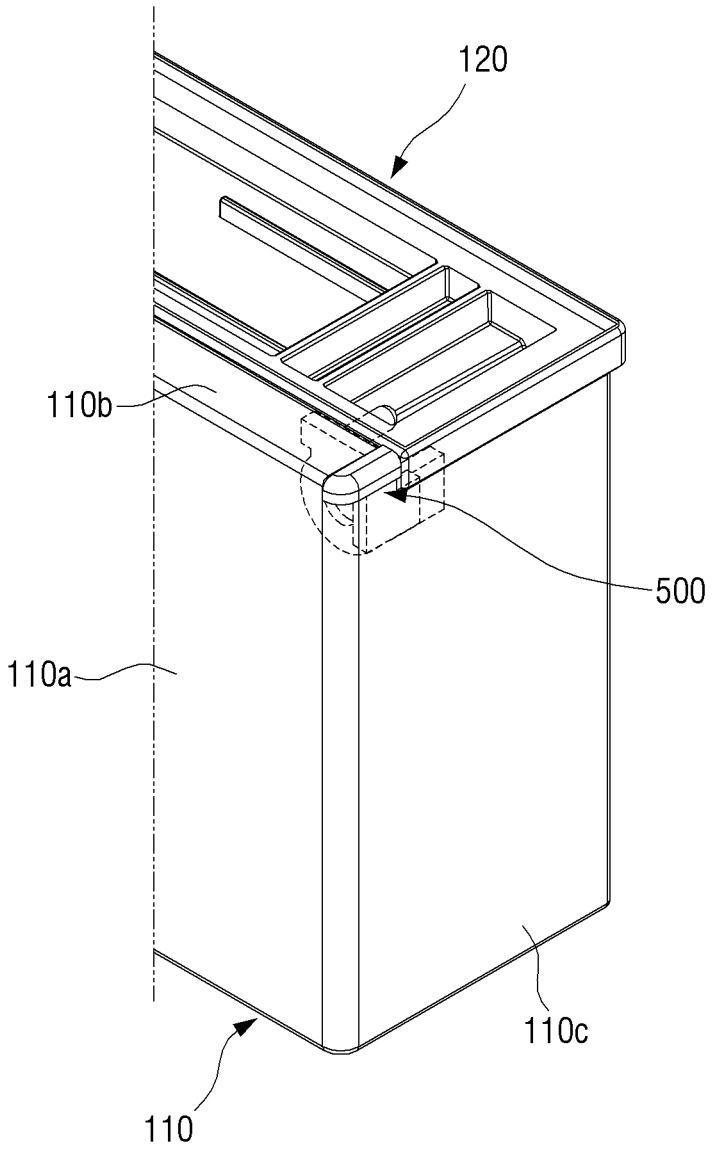
FIG. 12 is a diagram illustrating an appearance in which the frame panel, a corner member, and a control panel according to a fourth exemplary embodiment of the present disclosure are coupled with each other.
Figure 13:
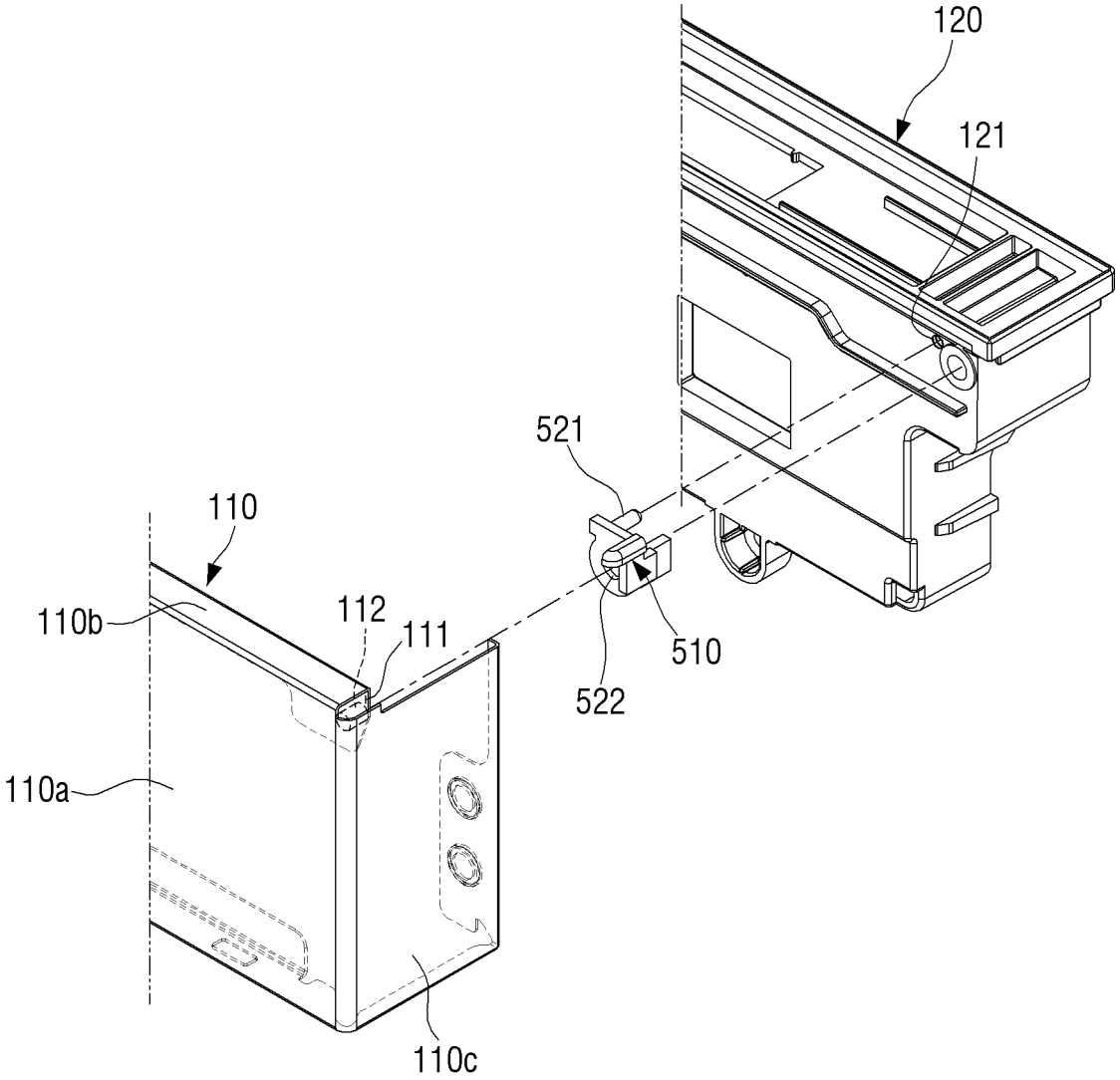
FIG. 13 is a diagram illustrating an appearance in which the frame panel, the corner member, and the control panel illustrated in FIG. 12 are separated from each other.
Figure 14:
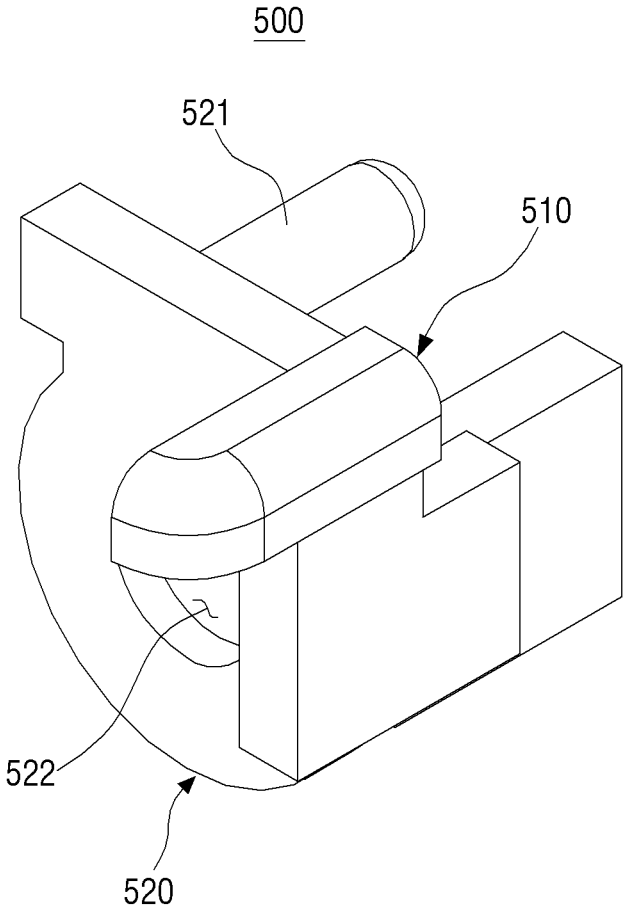
FIG. 14 is an enlarged view of the corner member illustrated in FIG. 12.

FIG. 12 is a diagram illustrating an appearance in which the frame panel 110, a corner member 500, and the control panel 120 according to a fourth exemplary embodiment of the present disclosure are coupled with each other, FIG. 13 is a diagram illustrating an appearance in which the frame panel 110, the corner member 500, and the control panel 120 illustrated in FIG. 12 are separated from each other, and FIG. 14 is an enlarged view of the corner member 500.

The control panel 120 is coupled with the rear of the frame panel 110 to configure the panel assembly or the door 100 of the dish washer 1 and the upper surface of the control panel 120 may be connected to the upper surface 110*b* of the frame panel 110. Further, the control panel 120 may be replaced with other frame panels or other panel assemblies.

The control panel 120 may be provided with an input member (not shown) for receiving an instruction for the operation of the dish washer 1 from a user. The input member may include various input means such as a button, a handle, a keyboard, and a touch screen, and the control panel 120 may have a predetermined space to be coupled with the input member.

The control panel 120 is coupled with the rear of the frame panel 110 so that the corner member 500 coupled with the frame panel 110 may be pressed toward the frame panel 110. In this way, the corner member 500 may be more firmly coupled with the frame panel 110.

The corner member 500 may include an exposed portion 510 and a buried portion 520. The configuration of the exposed portion 510 is similar to that of the exposed portion 210 according to the first exemplary embodiment of the present disclosure and therefore the detailed description thereof will be omitted.

The buried portion 520 may include at least one coupling portion 521. The coupling portion 521 may have a protrusion shape protruding toward the control panel 120. The control panel 120 may include a coupling hole 121 formed at a position corresponding to the position of the coupling portion 521 and the coupling portion 521 may penetrately be coupled with the coupling hole 121. In this way, the corner member 500 may be fixed to the control panel 120.

Further, the frame panel 110 may include at least one coupling protrusion 112 protruding toward the buried portion 520 and the buried portion 520 may have a coupling hole 522 formed at a position corresponding to the coupling protrusion 112 of the frame panel 110. Therefore, the coupling protrusion 112 of the frame panel 110 may be penetrately engaged with the coupling hole 522 of the buried portion 520. In this way, the corner member 500 may be more firmly coupled with the frame panel 110.

In addition, the coupling portion, the coupling protrusion, and the coupling hole may be formed in plural to correspond to each other on the frame panel, the corner member, or the control panel, and thus the corner member may be firmly fixed to the frame panel.

Figure 15:
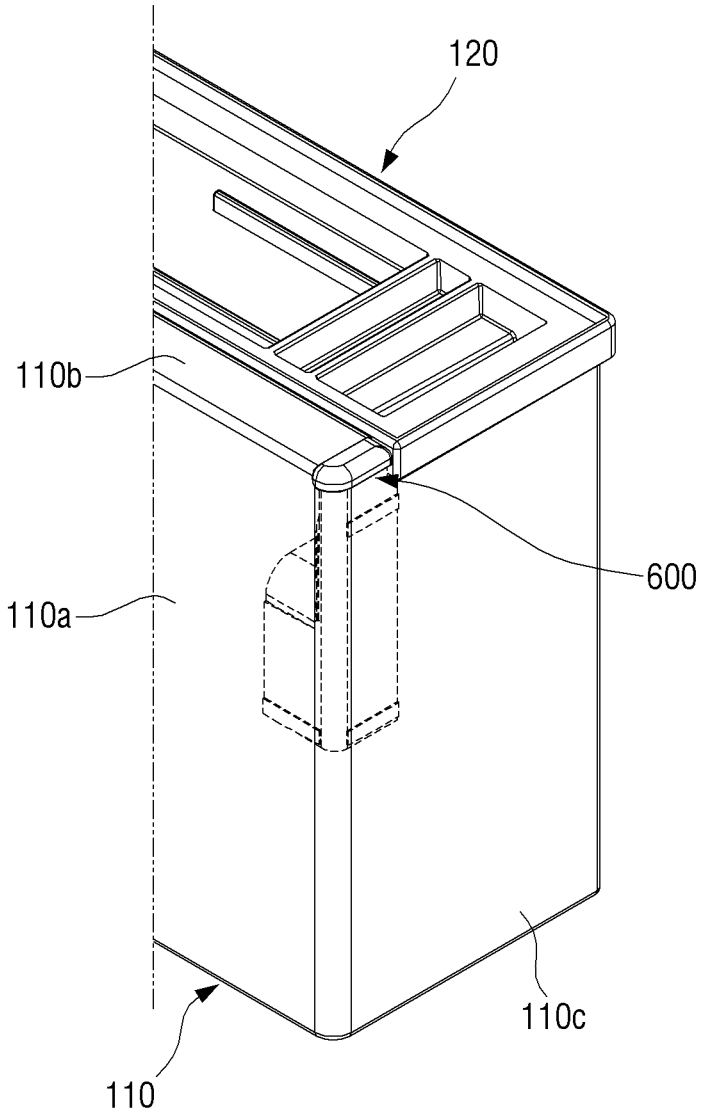
FIG. 15 is a diagram illustrating an appearance in which the frame panel, a corner member, and the control panel according to a fifth exemplary embodiment of the present disclosure are coupled with each other.
Figure 16:
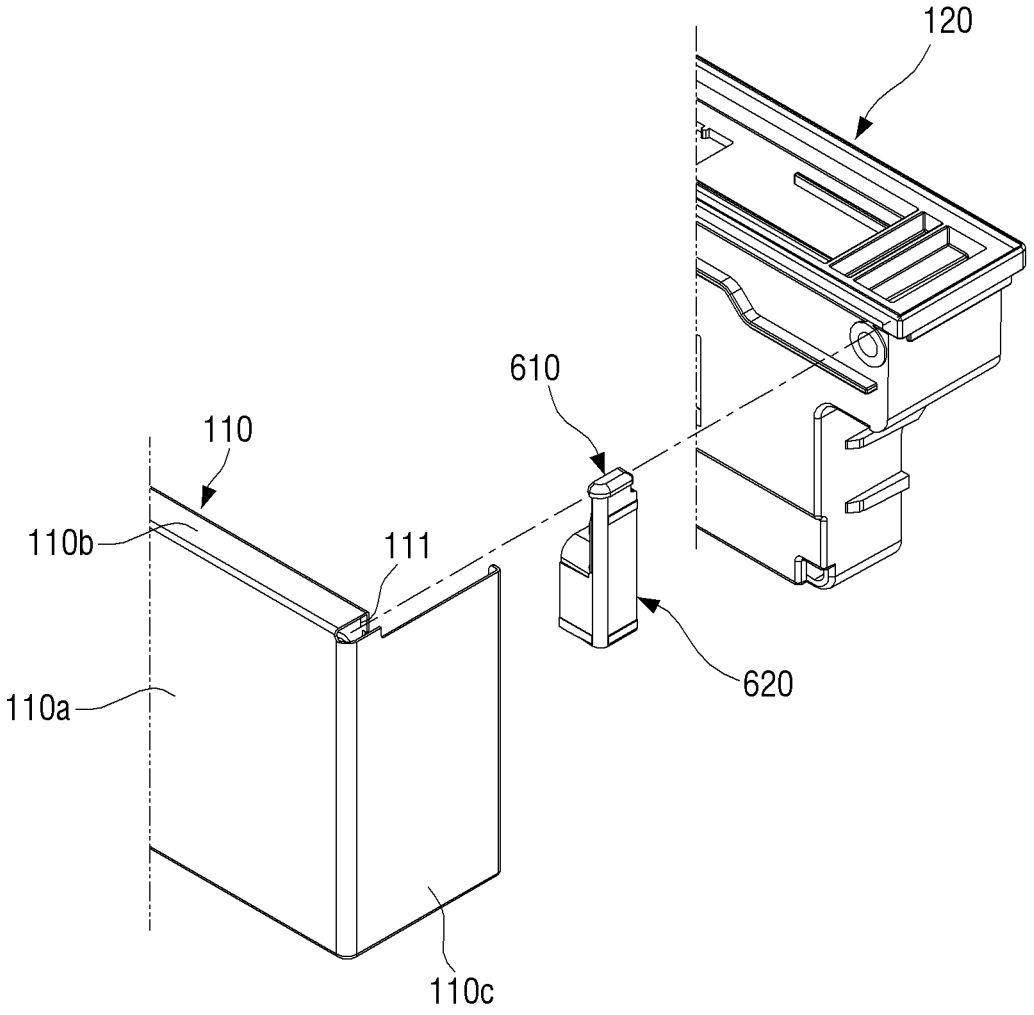
FIG. 16 is a diagram illustrating an appearance in which the frame panel, the corner member, and the control panel illustrated in FIG. 15 are separated from each other.
Figure 17:
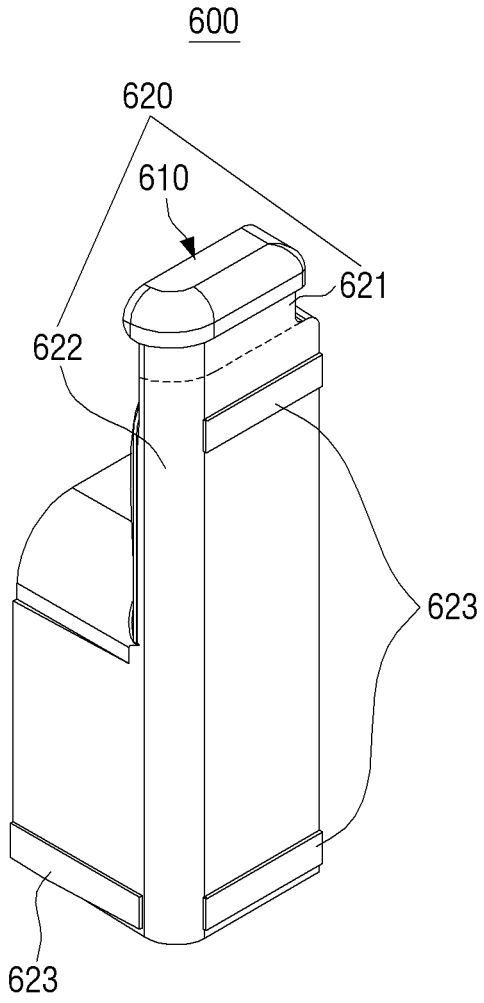
FIG. 17 is an enlarged view of the corner member illustrated in FIG. 15.

FIG. 15 is a diagram illustrating an appearance in which the frame panel 110, a corner member 600, and the control panel 120 according to a fifth exemplary embodiment of the present disclosure are coupled with each other, FIG. 16 is a diagram illustrating an appearance in which the frame panel 110, the corner member 600, and the control panel 120 illustrated in FIG. 15 are separated from each other, and FIG. 17 is an enlarged view of the corner member 600.

Hereinafter, the frame panel 110, a corner member 600, and the control panel 120 according to the fifth exemplary embodiment of the present disclosure will be described with reference to FIGS. 15 to 17.

The corner member 600 may include an exposed portion 610 and a buried portion 620. The configuration of the exposed portion 610 is similar to that of the exposed portion 210 according to the first exemplary embodiment of the present disclosure and therefore the overlapping description thereof will be omitted.

The buried portion 620 is formed by extending a part of a bottom surface of the exposed portion 610 and may be inserted into the frame panel 110 through the gap 111. The buried portion 620 may have a shape corresponding to the inner side of the frame panel 110 to be inserted into the frame panel 110. Further, the buried portion 620 may be press-fitted to the inner side of the frame panel 110.

In addition, the buried portion 620 may include an edge buried portion 622 that extends along an edge at which one end 621 of the buried portion 620 meets the front surface 110*a* and the side surface 110*c* of the frame panel 110.

The edge buried portion 622 may be formed to be thicker than one end 621 that is close to the exposed portion 610. Therefore, the edge buried portion 622 may have the increased contact area with the inside of the front surface 110*a* and the side surface 110*c* of the frame panel 110. In this way, the edge buried portion 622 may be firmly fixed to the inner side of the frame panel 110. Further, the buried portion 620 may further include a plurality of adhesive portions 623 to be firmly attached to the inner side surface of the frame panel 110. The adhesive portion 623 may include an adhesive or a double-sided tape.

The fifth exemplary embodiment of the present disclosure illustrates by way of example in which the buried portion 620 extends from the bottom surface of the exposed portion 610 and extends along the front surface 110*a* and the side surface 110*c* of the frame panel 110, but the buried portion 620 may also extend in another direction including the side surface of the exposed portion 610.

The control panel 120 is coupled with the rear of the frame panel 110 to contact the corner member 600 coupled with the frame panel 110. Further, the control panel 120 may press the corner member 600 toward the frame panel 110. In this way, the corner member 600 may be more firmly fixed to the frame panel 110.

Figure 18:
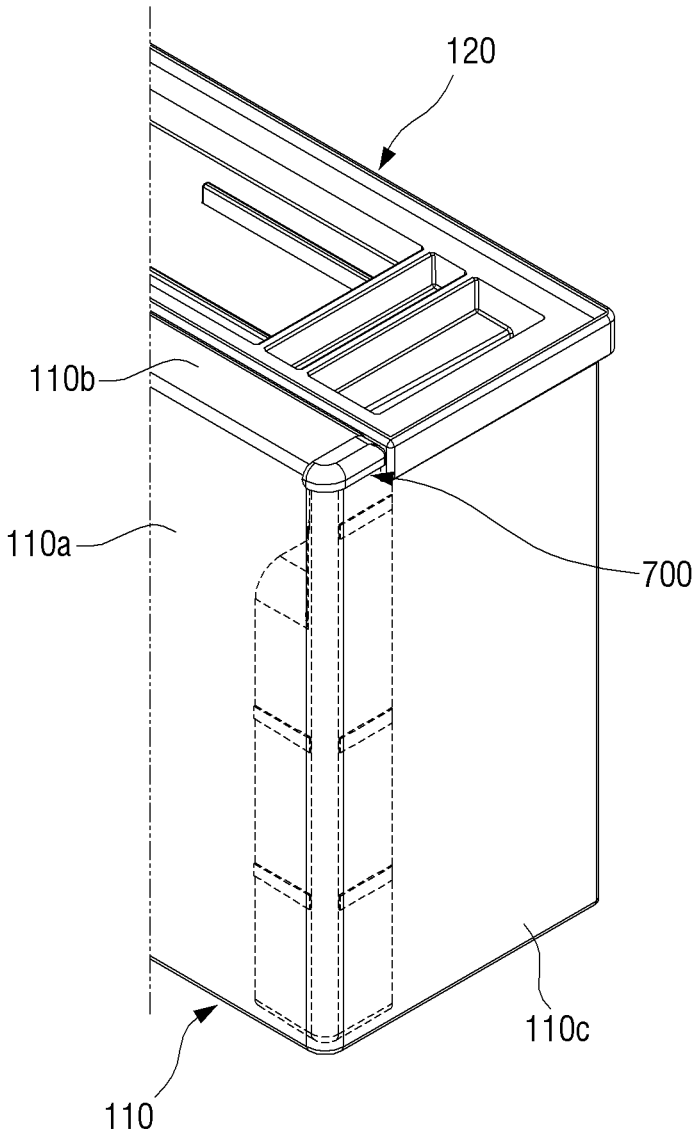
FIG. 18 is a diagram illustrating an appearance in which the frame panel, a corner member, and the control panel according to a sixth exemplary embodiment of the present disclosure are coupled with each other.
Figure 19:
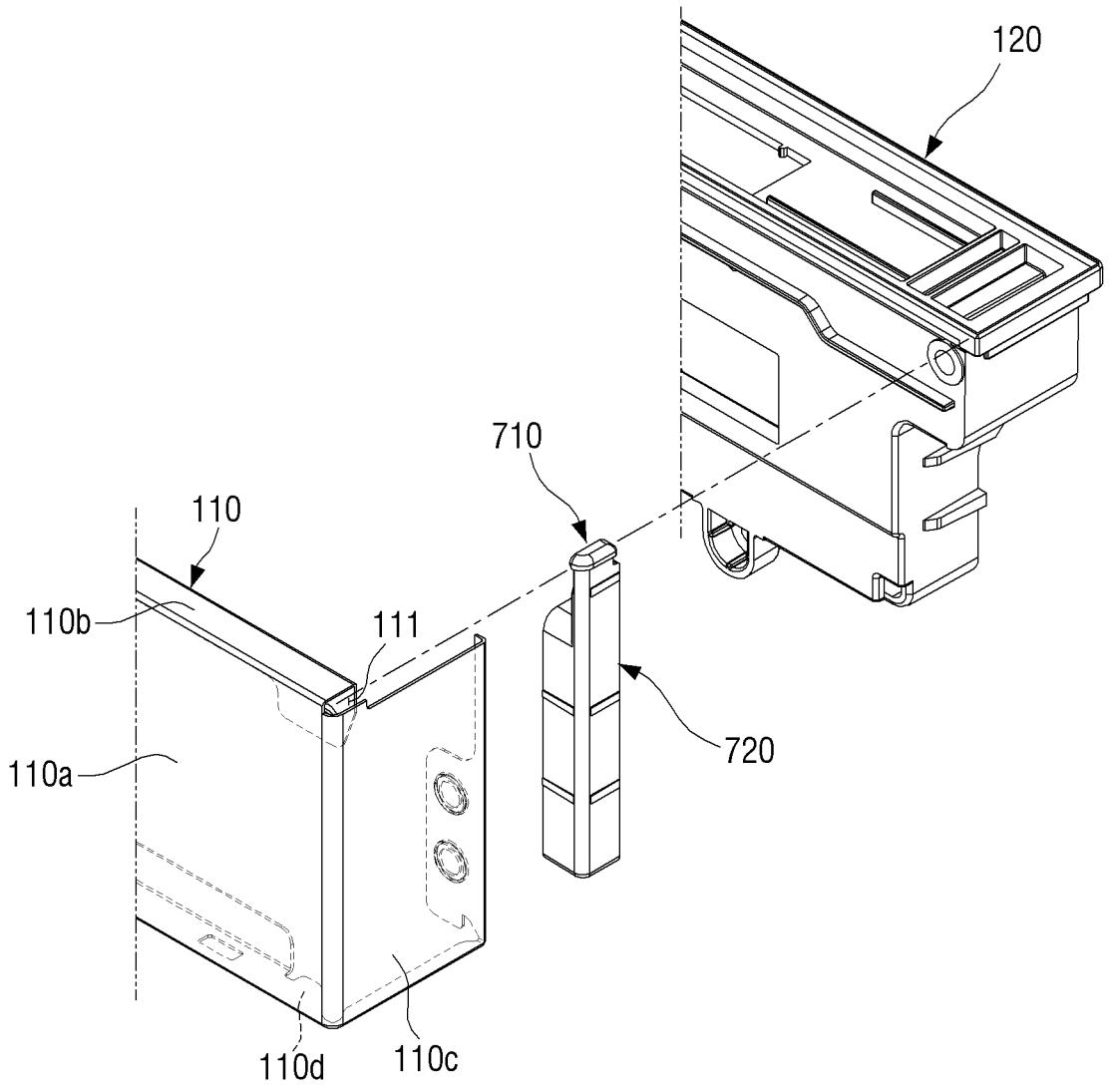
FIG. 19 is a diagram illustrating an appearance in which the frame panel, the corner member, and the control panel illustrated in FIG. 18 are separated from each other.
Figure 20:
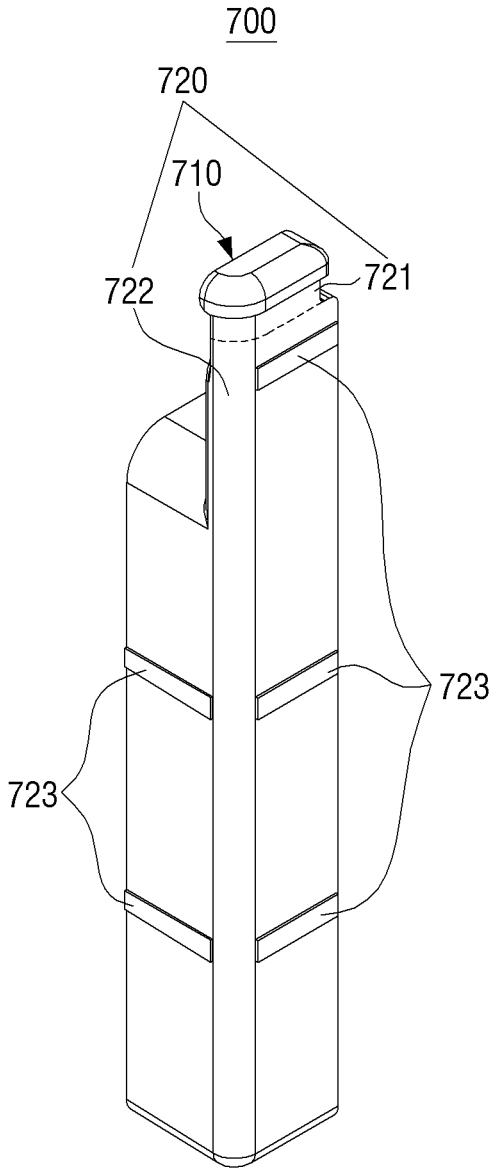
FIG. 20 is an enlarged view of the corner member illustrated in FIG. 18.

FIG. 18 is a diagram illustrating an appearance in which the frame panel 110, a corner member 700, and the control panel 120 according to a sixth exemplary embodiment of the present disclosure are coupled with each other, FIG. 19 is a diagram illustrating an appearance in which the frame panel 110, the corner member 700, and the control panel 120 illustrated in FIG. 18 are separated from each other, and FIG. 20 is an enlarged view of the corner member 700.

Hereinafter, the frame panel 110, a corner member 700, and the control panel 120 according to the sixth exemplary embodiment of the present disclosure will be described with reference to FIGS. 18 to 20.

The corner member 700 may include an exposed portion 710 and a buried portion 720. The configuration of the exposed portion 710 is similar to that of the exposed portion 210 according to the first exemplary embodiment of the present disclosure and therefore the overlapping description thereof will be omitted.

The buried portion 720 may include an edge buried portion 722 that extends along an edge at which one end 722 of the buried portion 721 meets the front surface 110*a* and the side surface 110*c* of the frame panel 110. The edge buried portion 722 is formed by extending a length of the edge buried portion 622 according to the fifth exemplary embodiment of the present disclosure up to a lower surface 110*d* of the frame panel 110. The frame panel 110 may have the lower surface 110*d* bent from the front surface 110*a* further provided with at a position opposite to the upper surface 110*b* thereof. Therefore, as illustrated in FIGS. 18 and 19, the edge buried portion 722 may extend up to the lower surface 110*d* of the frame panel 110 to be seated on the lower surface 110*d* of the frame panel 110. In this way, the buried portion 720 may be supported by the lower surface 110*d* of the frame panel 110. Therefore, the corner member 700 may be more firmly fixed to the frame panel 110.

Further, the buried portion 720 may further include a plurality of adhesive portions 723 to be firmly attached to the inner side surface of the frame panel 110. The adhesive portion 723 may include an adhesive or a double-sided tape.

Figure 21:
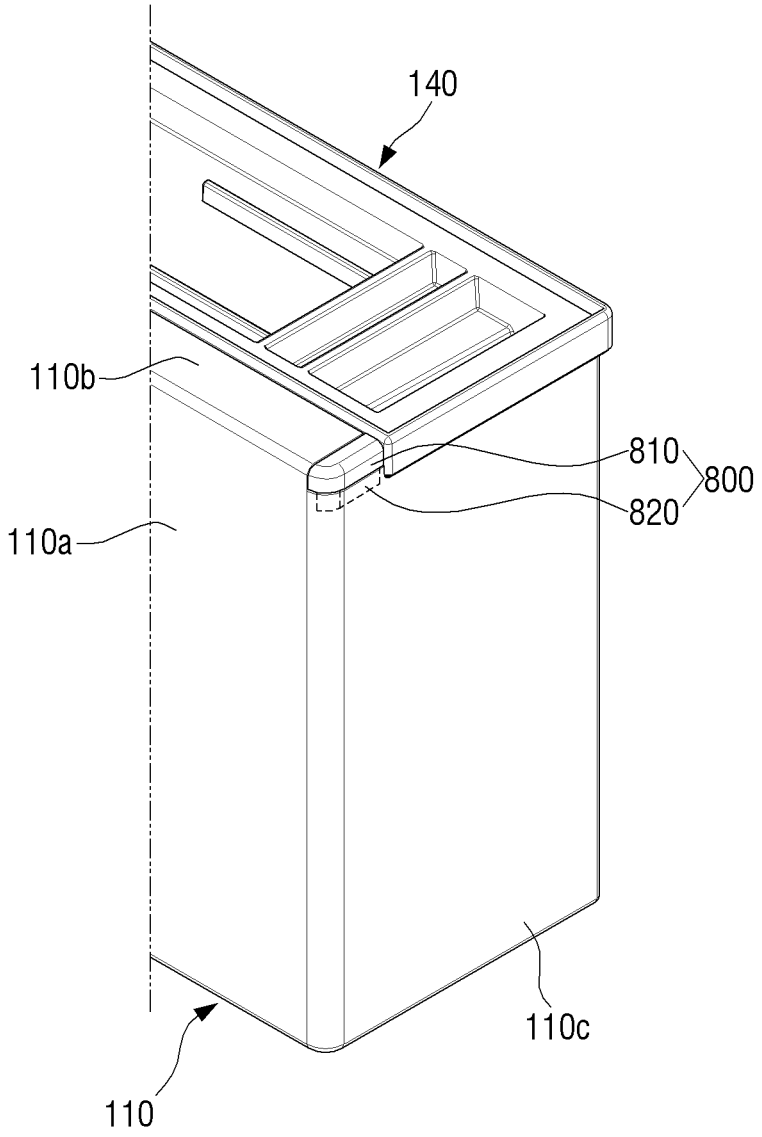
FIG. 21 is a diagram illustrating an appearance in which the frame panel and a control panel according to a seventh exemplary embodiment of the present disclosure are coupled with each other.
Figure 22:
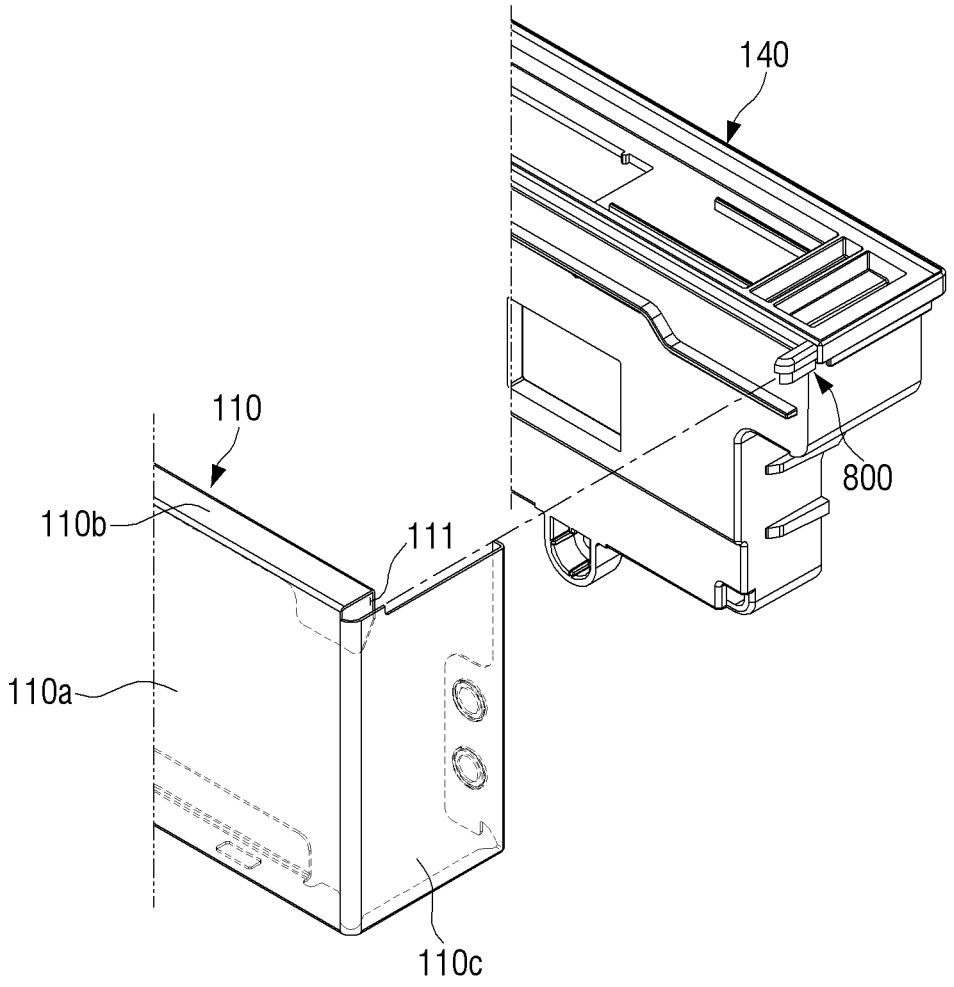
FIG. 22 is a diagram illustrating an appearance in which the frame panel and the control panel illustrated in FIG. 21 are separated from each other.

FIG. 21 is a diagram illustrating an appearance in which the frame panel 110 and a corner member 800 according to a seventh exemplary embodiment of the present disclosure are coupled with the control panel 140 integrally included and FIG. 22 is a diagram illustrating an appearance in which the frame panel 110 and the control panel 140 illustrated in FIG. 21 are separated from each other.

Hereinafter, the frame panel 110, the corner member 800, and the control panel 140 according to the seventh exemplary embodiment of the present disclosure will be described with reference to FIGS. 21 and 22.

The corner member 800 may include an exposed portion 810 and a buried portion 820 formed by extending a portion of a bottom surface of the exposed portion 810.

Further, the corner member 800 may be integrally formed at one side of the control panel 140. In this way, the control panel 140 integrally formed with the corner member 800 may be coupled with the rear of the frame panel 110, and thus the corner member 800 may be coupled with the gap 111 of the frame panel 110. Therefore, the corner member 800 integrally formed with the control panel 140 may be more firmly coupled than separately coupling the corner member with the frame panel 110, by an adhesion of the control panel 140 with the frame panel 110.

The corner members 200 to 800 according to various exemplary embodiments of the present disclosure described above may be made of a synthetic resin material and may be manufactured by the injection molding. Further, the frame panel 110 may consist of one sheet of metal plate. Therefore, the corner members 200 to 800 may be more easily molded into the desired shape and color than the frame panel 110 made of a metal material. In this way, even though the frame panel 110 is made of a metal material, the corner members 200 to 800 of the desired shape and color are coupled with the gap 111 of the frame panel 110 without separate welding or grinding and thus the edges of the frame panel 110 may be replaced with the desired shape and color.

Further, although various exemplary embodiments of the present disclosure describe the dish washer as one example of electronic appliances, various exemplary embodiments of the present disclosure may also be applied to various electronic appliances including the frame panel, such as a refrigerator and a microwave oven besides the dish washer.

Hereinabove, various exemplary embodiments of the present disclosure are individually described, but each exemplary embodiment need not necessarily be implemented alone and therefore the configurations and operations of each exemplary embodiment may also be implemented in combination with at least one other exemplary embodiment.

Although the preferred exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. A panel assembly, comprising:

a frame panel including a metal plate bent to form a front surface, an upper surface bent from the front surface, and a side surface bent from the front surface with a curved surface from the front surface to the side surface; and a corner member coupled with a gap formed between the upper surface of the frame panel and the side surface of the frame panel, wherein the corner member includes an exposed portion exposed to an outside of the frame panel and a buried portion covered by the front surface, the upper surface, and the side surface of the frame panel, and the exposed portion includes a rounded portion corresponding to the curved surface from the front surface to the side surface, and wherein the buried portion includes:

a first buried portion extending in parallel with the upper surface of the frame panel by extending a part of a side surface of the exposed portion, a second buried portion extending in parallel with the side surface of the frame panel by downwardly extending a part of a bottom surface of the exposed portion, and a third buried portion formed by rearwardly extending a part of a rear surface of the second buried portion and having a portion extending perpendicular to the second buried portion.

2. The panel assembly as claimed in claim 1, wherein the corner member is made of a synthetic resin material.

3. The panel assembly as claimed in claim 2, further comprising:

a control panel disposed at a rear of the frame panel, wherein the corner member includes a coupling portion coupled with the control panel.

4. The panel assembly as claimed in claim 1, wherein a surface connected to the side surface of the frame panel from the upper surface of the frame panel through the exposed portion of the corner member is formed without a step.

5. The panel assembly as claimed in claim 1, wherein the buried portion includes an edge buried portion extending along the curved surface to support the curved surface.

6. The panel assembly as claimed in claim 5, wherein the frame panel has a lower surface bent from the front surface, and wherein the edge buried portion extends to the lower surface of the frame panel.

7. The panel assembly as claimed in claim 1, wherein the exposed portion and the buried portion are integrally formed.

8. The panel assembly as claimed in claim 1, wherein the buried portion is formed to have a variable thickness.

9. The panel assembly as claimed in claim 1, wherein the buried portion includes at least one adhesive portion attached to an interior of the side surface of the frame panel.

10. An electronic apparatus, comprising:

a main body formed with an opening;

a door configured to open and close the opening; and a panel assembly including:

a frame panel including a metal plate bent to form a front surface, an upper surface bent from the front surface, and a side surface bent from the front surface with a curved surface from the front surface to the side surface; and a corner member coupled with a gap formed between the upper surface of the frame panel and the side surface of the frame panel, wherein the corner member includes an exposed portion exposed to an outside of the frame panel and a buried portion covered by the front surface, the upper surface, and the side surface of the frame panel, and the exposed portion includes a rounded portion corresponding to the curved surface from the front surface to the side surface, and wherein the buried portion includes:

a first buried portion extending in parallel with the upper surface of the frame panel by extending a part of a side surface of the exposed portion, a second buried portion extending in parallel with the side surface of the frame panel by downwardly extending a part of a bottom surface of the exposed portion, and a third buried portion formed by rearwardly extending a part of a rear surface of the second buried portion and having a portion extending perpendicular to the second buried portion.

11. The electronic appliance as claimed in claim 9, further comprising:

a control panel disposed at a rear of the frame panel, wherein the corner member is formed at one side of the control panel.

12. The electronic appliance as claimed in claim 11, further comprising:

a display part formed on the frame panel.

13. The electronic appliance as claimed in claim 9, wherein the frame panel is made of a metal material and the corner member is made of a synthetic resin material.

14. The electronic appliances as claimed in claim 13, wherein the exposed portion and the buried portion are integrally formed.

15. A dish washer, comprising:

a main body having an opening through which a dinner set is loaded into a washing space formed therein;

a door configured to open and close the opening; and a panel assembly including:

a frame panel including a metal plate bent to form a front surface, an upper surface bent from the front surface, and a side surface bent from the front surface with a curved surface from the front surface to the side surface; and a corner member coupled with a gap formed between the upper surface of the frame panel and the side surface of the frame panel, wherein the corner member includes an exposed portion exposed to an outside of the frame panel and a buried portion covered by the front surface, the upper surface, and the side surface of the frame panel, and the exposed portion includes a rounded portion corresponding to the curved surface from the front surface to the side surface, and wherein the buried portion includes:

a first buried portion extending in parallel with the upper surface of the frame panel by extending a part of a side surface of the exposed portion, a second buried portion extending in parallel with the side surface of the frame panel by downwardly extending a part of a bottom surface of the exposed portion, and a third buried portion formed by rearwardly extending a part of a rear surface of the second buried portion and having a portion extending perpendicular to the second buried portion.

16. The dish washer as claimed in claim 15, wherein the corner member is made of a synthetic resin material, and the exposed portion and the buried portion are integrally formed.

17. The dish washer as claimed in claim 16, wherein a surface connected to the side surface of the frame panel from the upper surface of the frame panel through the exposed portion of the corner member is formed without a step.

18. The dish washer as claimed in claim 15, further comprising:

a control panel disposed at a rear of the frame panel, wherein the corner member includes a coupling portion coupled with the control panel.

19. The dish washer as claimed in claim 18, further comprising:

a display part formed on the frame panel.

* * * * *